US005478133A

United States Patent [19]

Tidwell, Jr.

[11] Patent Number: 5,478,133

[45] **Date of Patent: * Dec. 26, 1995**

[54] MOTION FURNITURE CONSTRUCTION

[75] Inventor: Charles J. Tidwell, Jr., Tupelo, Miss.

[73] Assignee: L&P Property Management Company, Chicago, Ill.

[ * ] Notice: The portion of the term of this patent subsequent to Nov. 1, 2011, has been disclaimed.

[21] Appl. No.: 12,950

[22] Filed: Feb. 3, 1993

[51] Int. Cl.[6] ..... A47C 1/035

[52] U.S. Cl. ..... 297/85; 297/440.1; 297/440.21

[58] Field of Search ..... 297/440.21, 440.16, 297/440.1, 440.23, 85

[56] References Cited

U.S. PATENT DOCUMENTS

| | | | |
|---|---|---|---|
| 2,732,889 | 1/1956 | Healey . | |
| 3,128,123 | 4/1964 | Schreier | 297/440.1 |
| 3,228,725 | 1/1966 | Rowe | 297/440.1 |
| 3,525,549 | 8/1970 | Knabusch et al. | 297/440.21 |
| 3,537,747 | 11/1970 | Rogers, Jr. | 297/85 |
| 3,690,723 | 9/1972 | McClain | 297/85 |
| 3,730,585 | 5/1973 | Rogers, Jr. et al. | 297/85 |
| 5,186,518 | 2/1993 | Pine | 297/85 |
| 5,288,126 | 2/1994 | Saul | 297/85 |
| 5,360,255 | 11/1994 | Cook et al. | 297/232 |

FOREIGN PATENT DOCUMENTS

| | | | |
|---|---|---|---|
| 41320 | 1/1969 | Finland | 297/440.21 |

*Primary Examiner*—Jose V. Chen
*Assistant Examiner*—David E. Allred
*Attorney, Agent, or Firm*—Wolf, Greenfield & Sacks

[57] ABSTRACT

Motion furniture constructed so that the arm or arms, backrest and ottoman are first upholstered and then assembled to the reclining mechanism and seat frame of the furniture, either by the furniture manufacturer, dealer, or consumer.

12 Claims, 9 Drawing Sheets

MOTION FURNITURE CONSTRUCTION

RELATED APPLICATIONS

This application is related to U.S. application Ser. Nos. 07/694147 filed May 1, 1991 and 07/879,157 filed Apr. 30, 1992 assigned to the owner of the present application.

INTRODUCTION

This invention relates to motion furniture and more particularly comprises ready-to-assemble motion furniture and the method by which the furniture is constructed.

Motion furniture as used herein is a generic term for chairs, sofas, and loveseats that include one or more reclining seats. With respect to the sofas and loveseats, they may be of modular or sectional construction. The reclining seats may either be incliners (utilizing a two-way mechanism that maintains the seat and backrest in fix positions with respect to one another) or recliners (that employ a three-way mechanism that enables the backrest to move relative to the footrest as the seat moves to the fully reclined position).

Conventionally in the manufacture of motion furniture, the wood frames of the base, arms, back and seat are connected to the metal reclining mechanisms, and thereafter the upholstery including the padding and fabric cover are applied to the arms, seat and backrest. Once assembled, the furniture cannot be disassembled without removing at least in part the padding and/or fabric covering. As a result, conventionally made furniture is fully assembled at the factory and shipped in the fully assembled state. This practice has many disadvantages. First, a straight line assembly is employed that limits the manufacturing speed to the slowest operation in the manufacturing process. Second, the application of the upholstery to the frame is difficult and a number of highly skilled upholsterers are required in order to keep the manufacturing line moving. Another disadvantage of furniture manufactured in this manner is that repairs frequently require that the furniture be shipped back to the factory because opening and removing a portion of the upholstery involved in the repair requires skills beyond those of many of the mechanics employed by dealers.

Other disadvantages of conventionally manufactured motion furniture relate to freight and packaging. The preassembled furniture does not lend itself to packaging in rectangular cartons. Rather, the cartons are of irregular shape and, therefore, do not stack efficiently and compactly. This in turn frequently results in damaged furniture and excessive freight costs. Yet another disadvantage of the preassembled furniture is that it is large, heavy and difficult to get through doorways. Many upholstered motion furniture pieces require minimum door opening widths of three feet in order for the furniture to be moved through them.

Recently, certain motion furniture manufacturers have attempted to reduce freight and handling charges and eliminate some of the damage of the packaging of the furniture by including "knocked-down" backs for the reclining seats. In this construction, the back of the reclining seat is mounted by means of releasable brackets onto the backrest portion of the reclining mechanism, and the fully upholstered backrest for shipping and handling is placed on the seat so that the furniture is more nearly cube-shaped and may therefore be packaged in a rectangular carton. While the "knocked-down" back construction has resulted in some savings both in handling and shipping, it does not eliminate all the manufacturing disadvantages described above with reference to the conventional fully preassembled motion furniture.

One important object of the present invention is to reduce the manufacturing costs of upholstered motion furniture.

Another important object of the present invention is to provide upholstered motion furniture that may be assembled by the retailer or consumer so as to greatly reduce freight and handling costs by maximizing packaging efficiency with respect to shape and volume.

Yet another important object of the present invention is to provide upholstered motion furniture that allows defective parts to be easily removed and replaced without shipping the entire furniture back to the manufacturing source.

Still another important object of the present invention is to provide an improved manufacturing process for upholstered motion furniture that lends itself to automation, produces better quality furniture at greater speed, and allows product to be manufactured with fewer people.

To accomplish these and other objects, motion furniture is manufactured in accordance with the present invention by separately making the wood bases, upholstered arms, upholstered seat, upholstered back, upholstered ottoman, and metal reclining chair mechanisms. Thereafter the separately made upholstered parts may be assembled by the manufacturer, dealer or consumer as the situation dictates. Furniture made in accordance with this invention eliminates the disadvantages of the conventional motion furniture described above. In addition, it allows the manufacturer to inventory a variety of furniture parts so that they may be assembled in different styles and thereby reduce total inventory requirements.

These and other objects and features of the present invention will be better understood and appreciated from the following detailed description read in connection with the accompanying drawings.

BRIEF FIGURE DESCRIPTIONS

DETAILED DESCRIPTION

Figure 1:
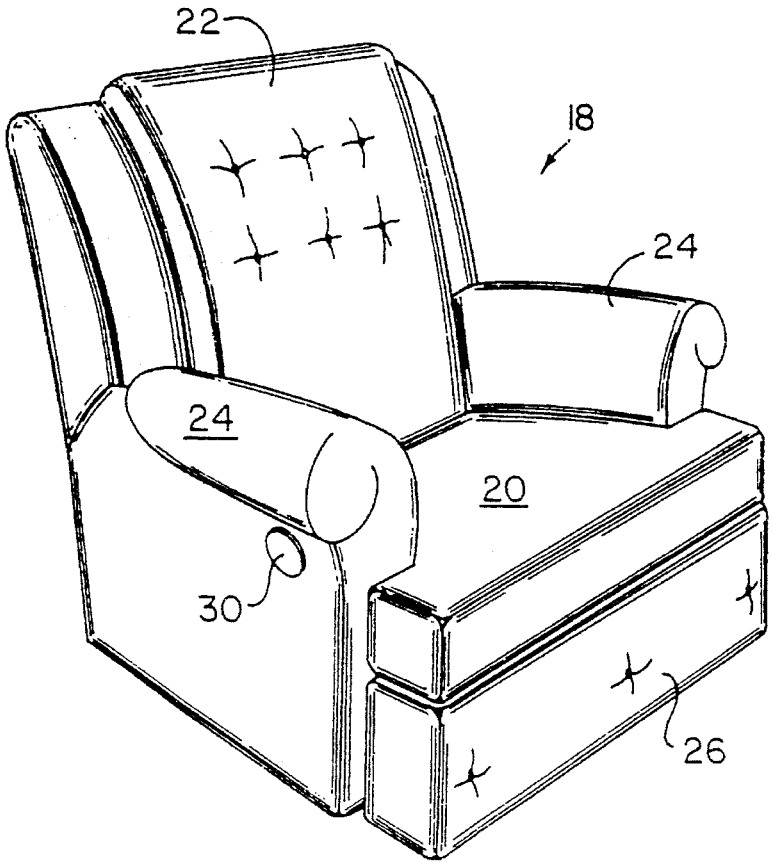
FIG. 1 is a perspective view of a recliner embodying this invention, shown in the upright position.
Figure 2:
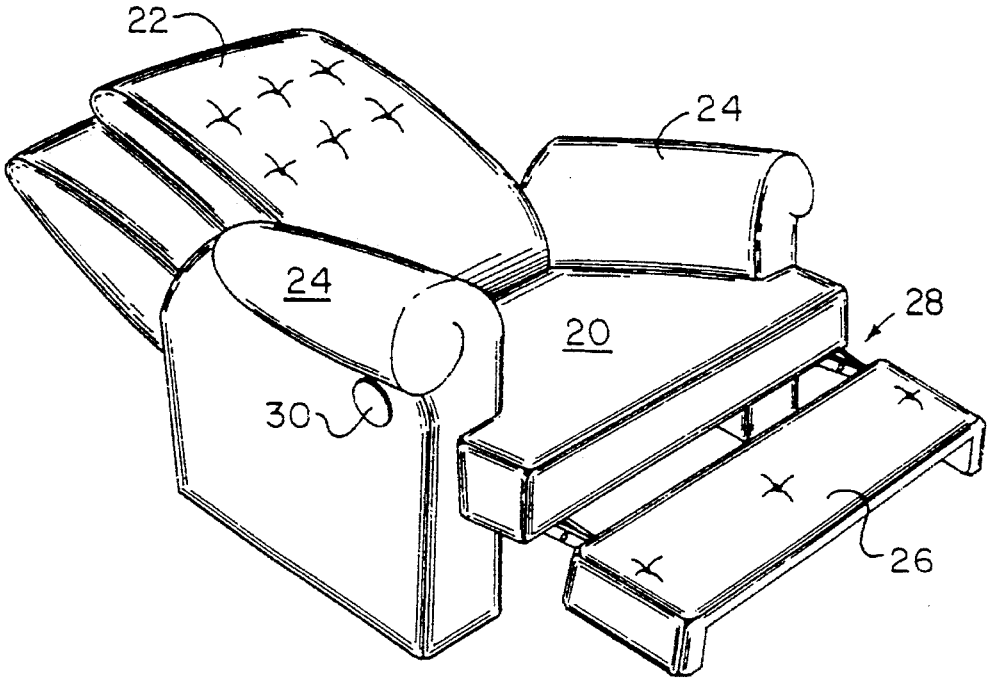
FIG. 2 is a view similar to FIG. 1 showing the chair in a reclining position.

In FIG. 1 a reclining chair 18 constructed in accordance with the present invention is shown in the upright position. The chair includes a seat 20, a backrest 22, arms 24 and ottoman 26. The particular chair shown is a three-way recliner, which is determined by the mechanism 28 used to support the seat and backrest in the assembly. However, the invention is not restricted to the construction of three-way recliners, but is equally applicable to the construction of two-way incliners as well and whether they be incorporated into a chair, loveseat, sofa or other types of seating. In FIG. 1, a push-button type control 30 is shown mounted in the right arm of the chair and it is used to unlock the reclining mechanisms 28 so that the position of the chairs may be changed from the upright to the partially reclined and fully reclined configurations as shown in FIG. 2. What has been described thus far is conventional motion furniture that has been manufactured widely and sold in great numbers for many years.

Figure 4:
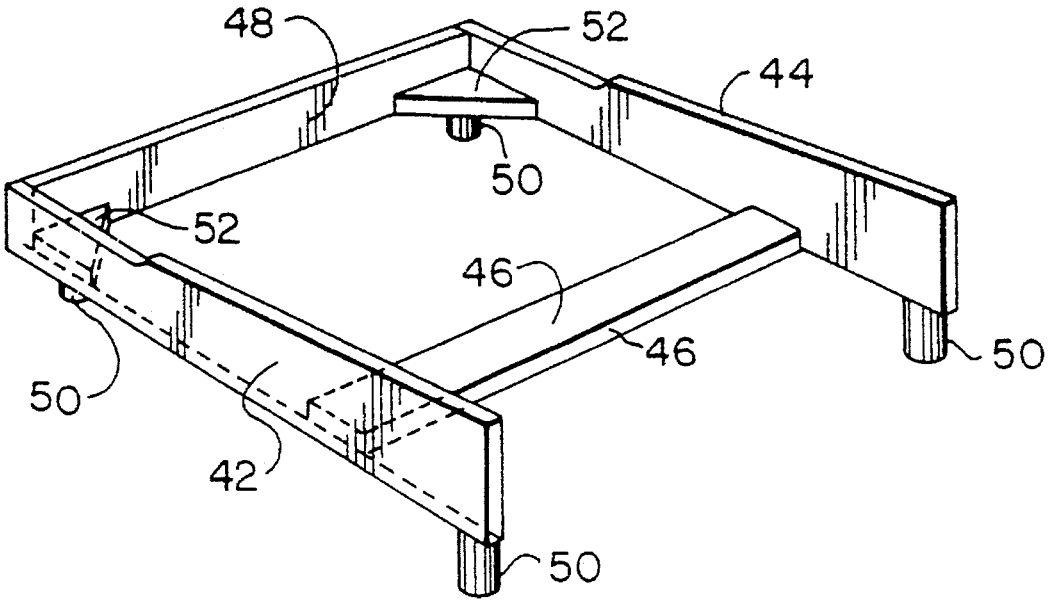
FIG. 4 is a perspective view of the base of the chair shown in FIG. 1.

In accordance with the present invention, the various components of the chair are supported on a wood base 40 (see FIG. 4) composed of a pair of wood side rails 42 and 44 and front and rear wood cross rails 46 and 48. The rear cross rail 48 is connected to the rear ends of the side rails 42 and 44 while the front cross rail 46 is connected to the side rails approximately one-quarter of the way back from their front ends. Moreover, in the embodiment shown, the side rails 42 and 44 and the rear rail 48 are oriented vertically while the front cross rail 46 is disposed in the horizontal position. The side and cross rails conventionally may be secured together by screws and bolts, brackets and/or braces or any other type of fastener which will provide the needed strength and rigidity. The base 40 is shown in FIG. 4 to be supported on four feet 50 attached to it. In FIG. 4 the front feet 50 are shown connected to the front ends of the side rails 42 and 44 while the rear feet 50 are shown connected to corner braces 52 that join the rear cross rail 48 to the side rails.

Figure 5:
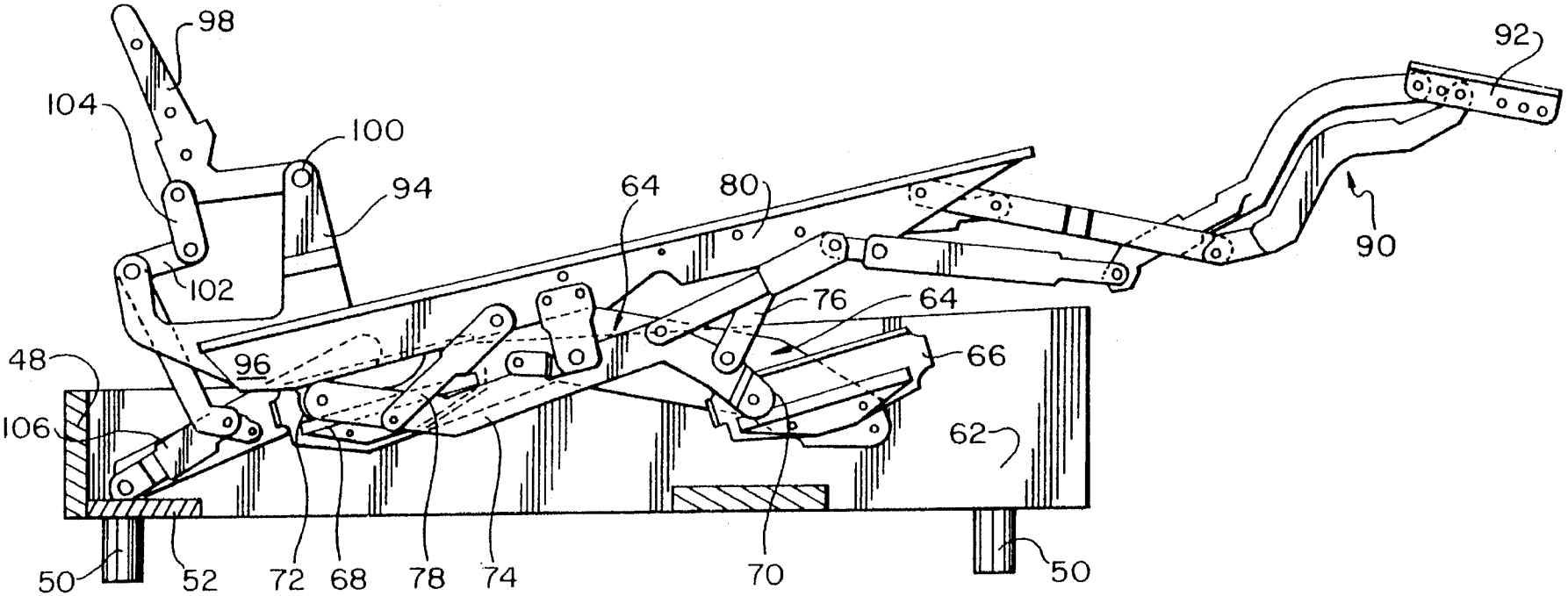
FIG. 5 is an inside elevation view off one side rail of the base with a reclining chair mechanism mounted on the side rail and with the mechanism in a reclining position.
Figure 7:
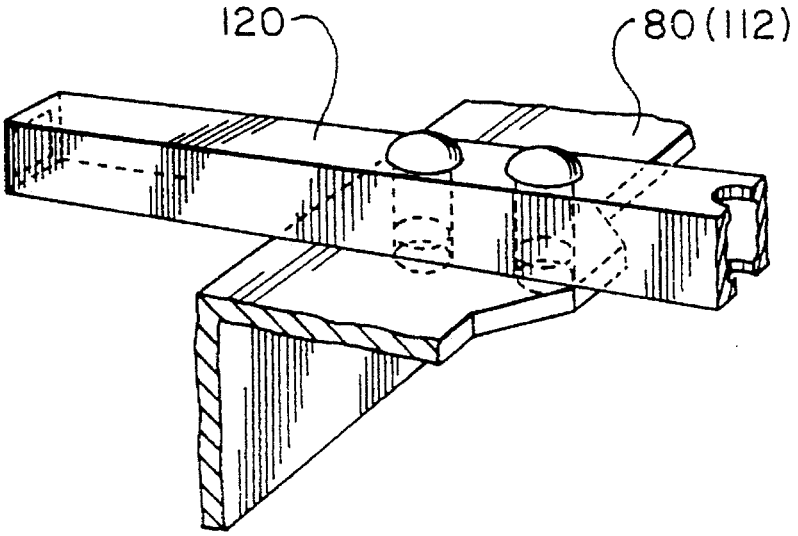
FIG. 7 is a fragmentary cross-sectional view of the metal seat frame of FIG. 6 shown incorporated into the reclining chair mechanism of FIG. 5.

Reclining chair mechanisms 28 are mounted on the inner surfaces 62 of the side rails 42 and 44 of wood base 40. As indicated, the mechanisms may take a variety of different forms and may provide either two-way or three-way reclining action. The mechanism illustrated is that shown in U.S. application Ser. No. 07/879,157 supra. Separate mechanisms are provided on each side rail and the two are mirror images of one another. That is, they comprise identical parts but the stacking of the various parts of the mechanism is reversed on the left and right sides. One such mechanism is shown in FIG. 5.

Each mechanism 28 includes a mounting plate 64 which is a relatively large steel plate fastened in face-to-face relationship on the inside 62 of the side rails by bolts that extend through the side rails. The mounting plate 64 carries forwardly and upwardly extending inclined front and rear tracks 66 and 68 that are fixed with respect to the mounting plate and have upper and lower flanges that retain rollers which move within the tracks. Those rollers 70 and 72 are mounted on the front and rear ends respectively of a roller link 74. Roller link 74 which is the main support for the seat 20 and backrest 22 carries front and rear pivot links 76 and 78 connected by rivets to the roller link, and the upper ends of the front and rear pivot links 76 and 78 are in turn connected to and carry the seat mounting link 80. When the chair 18 moves from the upright to the intermediate or TV position, the seat 40 moves forwardly and slightly downwardly with respect to the base 40 as pivot links 76 and 78 pivot counterclockwise as viewed in FIG. 5.

A lazy tong linkage 90 connected to the front end of the seat mounting link carries an ottoman bracket 92 that in turn supports the ottoman 26. As the details of the mechanism 28 do not form part of the present invention, the ottoman linkage is not described in great detail. Suffice it to say that when the chair is moved from the upright to the reclined position, the lazy tong linkage 90 elevates and raises the ottoman from a position wherein it lies beneath the front edge of the seat as shown in FIG. 1, substantially to the plane of the seat as shown in FIG. 2.

The mechanism 28 also includes a rear bracket 94 that is mounted on the rear end 96 of the seat mounting link 80 and is fixed with respect thereto. The rear bracket 94 pivotally supports the backrest mounting link 98 which is secured to it by rivet 100. A back drive crank 102 is also pivoted intermediate its ends to the rear bracket 94. Drive crank 102 in turn is pivotally connected at one end to a short link 104 which in turn is connected to the backrest mounting link 98. The other end of the back drive crank 102 is connected to the rear end of the mounting plate 64 by connector link 106.

When the chair moves from the upright to the TV or intermediate reclined position, that action is achieved by the pivot links 76 and 78 pivoting in a forwardly and downwardly direction on the stationary roller link 74. During that action, the backrest mounting link 98 remains fixed with respect to the seat mounting link 80. When the chair moves from the intermediate to the fully reclined positions, the rollers 70 and 72 move forwardly and upwardly on the tracks 66 and 68 so as to move the seat mounting link 80 forwardly and upwardly with respect to the base 40, and at the same time the backrest mounting link 98 pivots rearwardly with respect to the seat mounting link 80 through the action of the connector link 106, back drive crank 102 and the short link 104.

Figure 6:
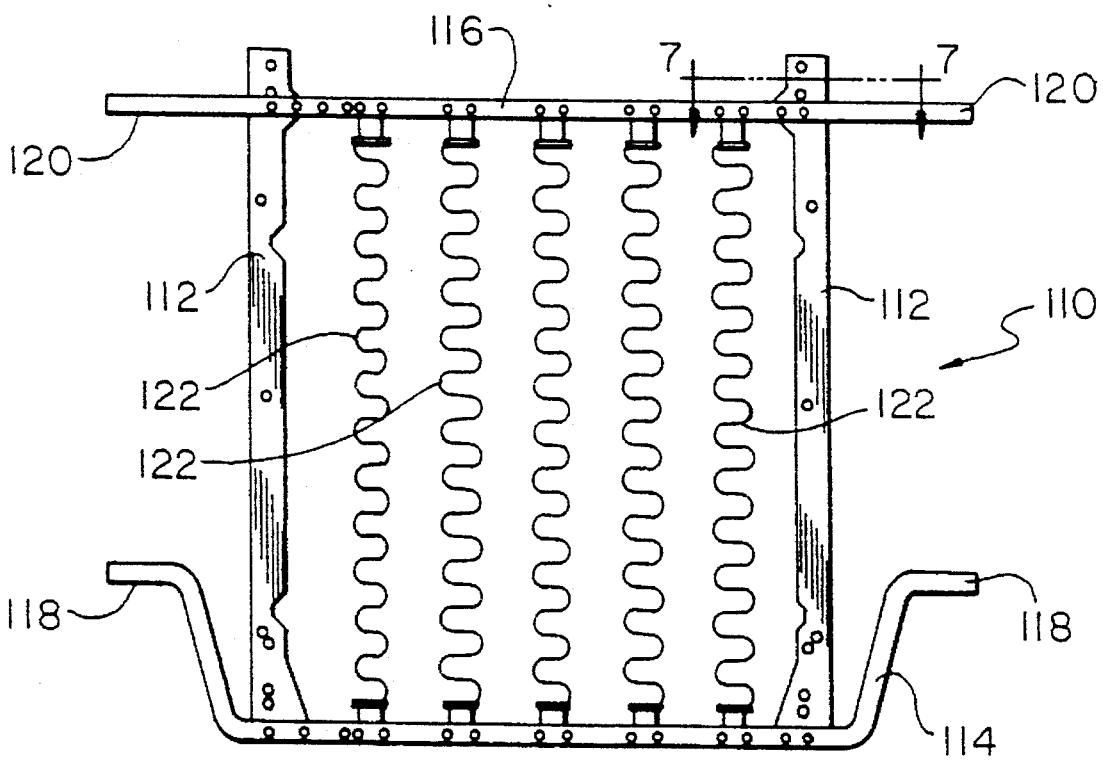
FIG. 6 is a plan view of the metal seat frame employed in the chair of FIG. 1.

The seat frame 110 shown in FIG. 6 includes a pair of metal side rails 112 connected by front and rear metal cross tubes 114 and 116. As explained below, the seat frame side rails 112 may be one and the same with the seat mounting links 80. The cross tubes have ends 118 and 120, respectively that extend beyond the side rails 112. When the metal seat frame 110 is mounted on or incorporated into the chair mechanisms the ends 118 and 120 extend beyond the side rails 42 and 44 of the base so that the arms 24 may be directly connected to the seat frame and be carried by it. This is described in detail below in connection with the assembly operation of the chair and is shown in part in U.S. application Ser. No. 07/694,147 supra.

The seat frame also includes sinuous springs 122 that extend front to back between the cross tubes 114 and 116. The springs 122 provide a resilient support for a seat pad and seat cushion as described below.

Figure 10:
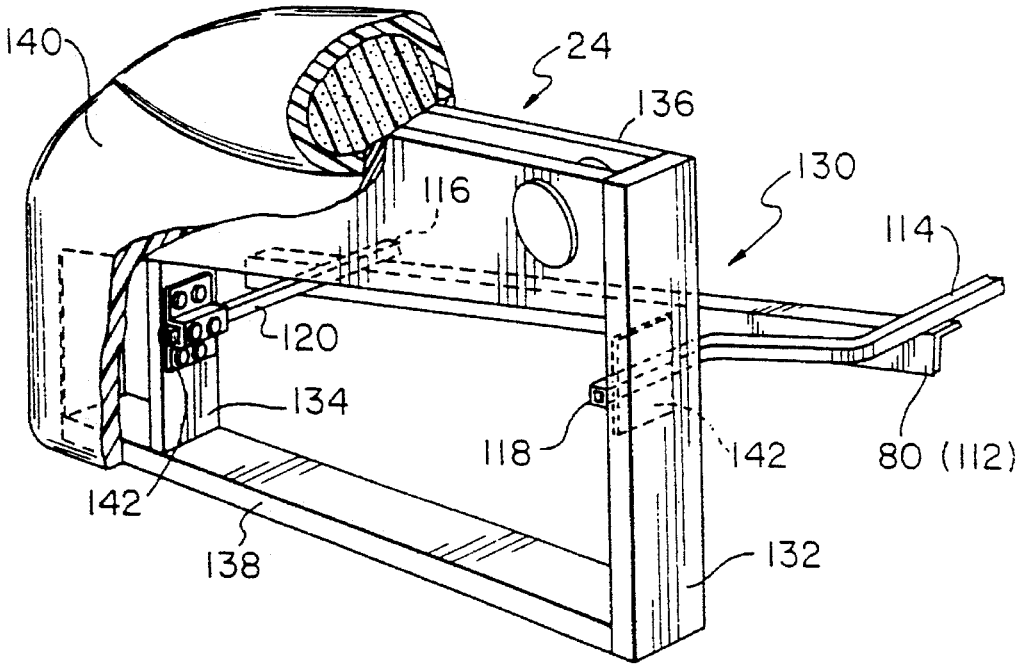
FIG. 10 is a perspective view of one arm of the chair of FIG. 1 with part of the upholstery and padding broken away, showing the manner in which the arm is attached to the metal seat frame of FIG. 6.

The upholstered armrests 24 are mirror images of one another and with the exception of the push-button actuator 30 which is provided in the right arm in the chair shown, the construction of the arms correspond with one another, element for element. Therefore, only one arm need be described. The arm 24 shown in FIG. 10 includes a wood frame having front and rear posts 132 and 134 and top and bottom rails 136 and 138 that are joined together to form a generally rectangular frame. One or more intermediate side horizontal rails and vertical posts may be incorporated into the frame of the arm to increase its stiffness and durability. The box frame of the arm described above may or may not be provided with either plywood or a cardboard-like material on the inner and outer vertical surfaces to support the padding and upholstery fabric 140 applied to the arm.

In accordance with the present invention, brackets 142 are provided on the rear face of the front post 132 and the front face of the rear post 134 of the arm, and the brackets 142 engage the ends 118 and 120 of the cross tubes 114 and 116 of the seat frame 110 so as to mount each arm on the seat frame. The arms may be retained on the tubes by bolts, pins, or other means so as to prevent the arms from being pushed off the cross tubes by outwardly directed forces exerted on the arms such as may be exerted by the occupant of the seat.

Figure 11A:
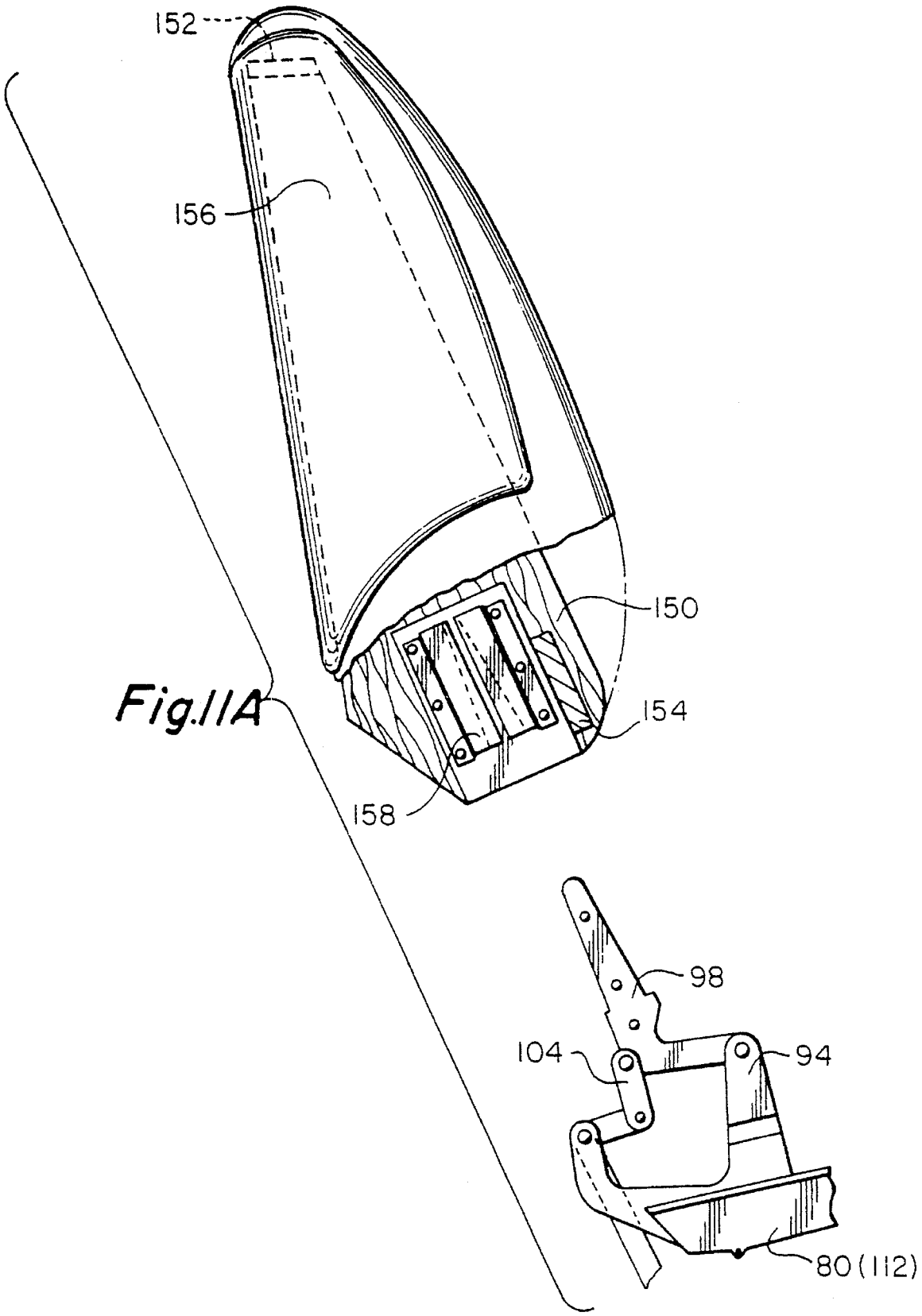
FIG. 11A is an exploded perspective view of the backrest of the chair of FIG. 1 with part of the upholstery and padding broken away, and showing the mating portion of the mechanism to which it attaches.
Figure 11B:
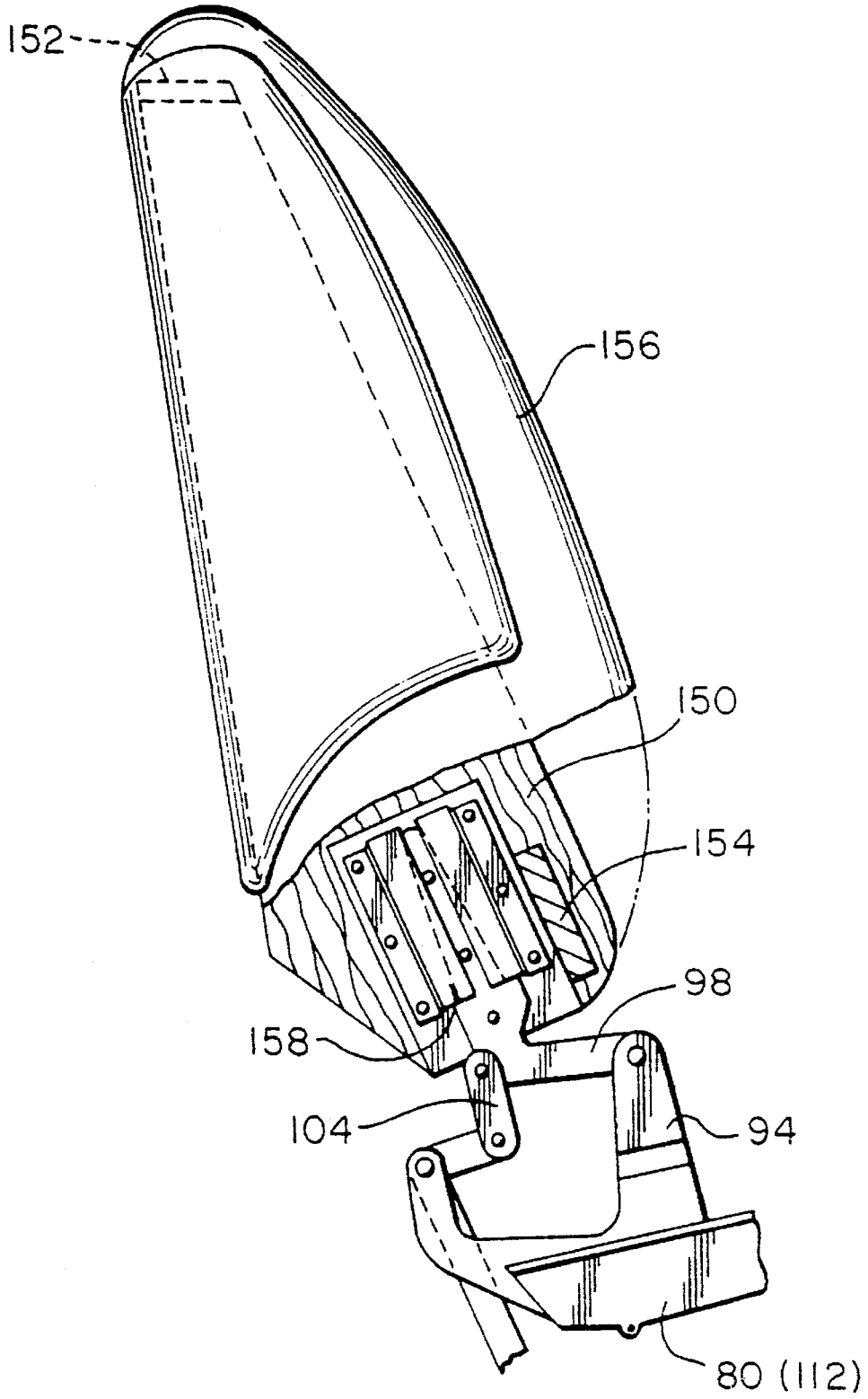
FIG. 11B is similar to FIG. 11A but showing the backrest attached to the mechanism.

The backrest 22 is made as a separate unit from the arms 24 and seat 20 and includes a pair of parallel vertical side rails 150, a top rail 152 and a bottom cross rail 154. Depending on the particular style of chair, the back may include wings that extend outwardly, forwardly and/or rearwardly of the front surface of the cushioned backrest. Supplementary frame members may be included to build up the backrest to the desired shape. Thereafter, the box frame of the backrest established by the side, top-and bottom rails and other members may be provided with thin plywood or cardboard-like panels on the front and back surfaces to support the padding and upholstery fabric 156 that covers, the front, back and sides of the backrest. As shown in FIGS. 11*a* and 11B, the inner surfaces of the vertical side rails 150 of the backrest carry mounting brackets 158 having slots that receive the backrest mounting links 98 of the mechanism 28. To attach the backrest 22 to the reclining mechanism 28, the brackets 158 on each of the vertical side rails 150 of the backrest are aligned with the backrest mounting links 98, and the links 98 simply slip into the slots of brackets 158. In this manner, the backrest is retained in place. Screws or pins may be used if needed to prevent accidental removal of the backrest.

Figure 3:
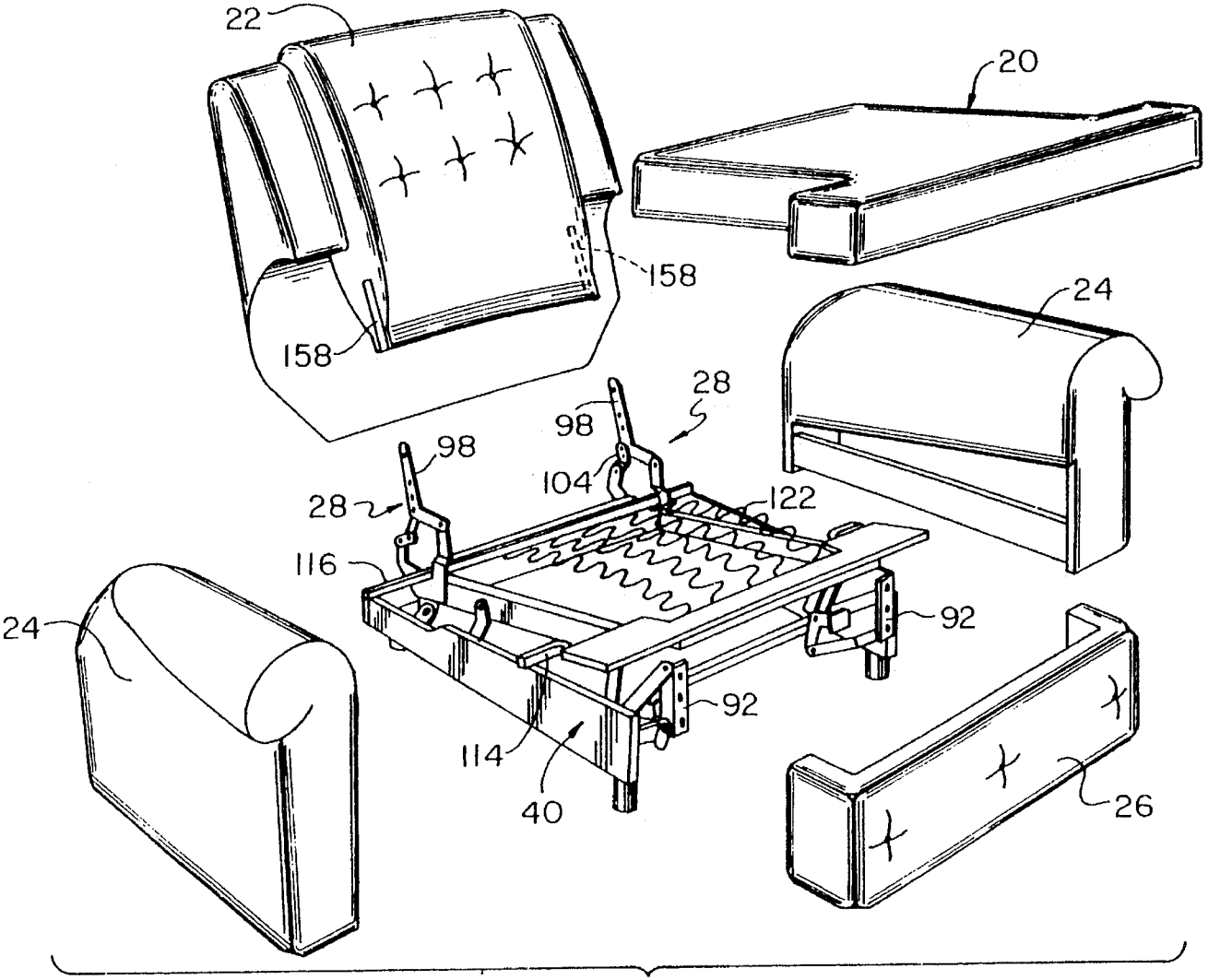
FIG. 3 is partially exploded perspective view of the chair shown in FIG. 1.
Figure 8:
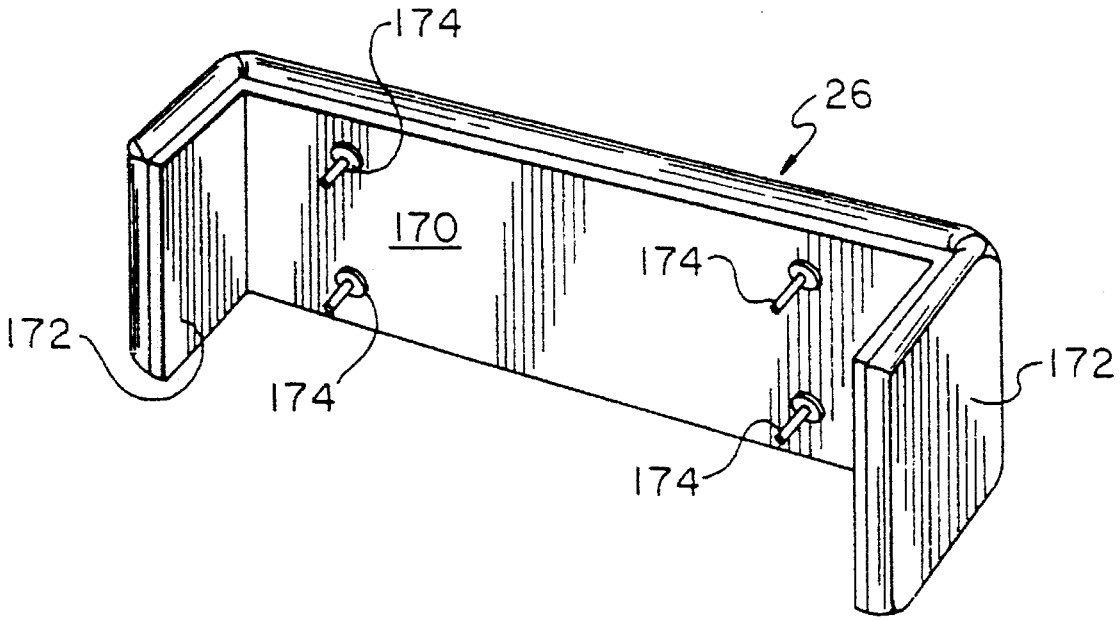
FIG. 8 is a bottom perspective view of the ottoman of the chair of FIG. 1.
Figure 9:
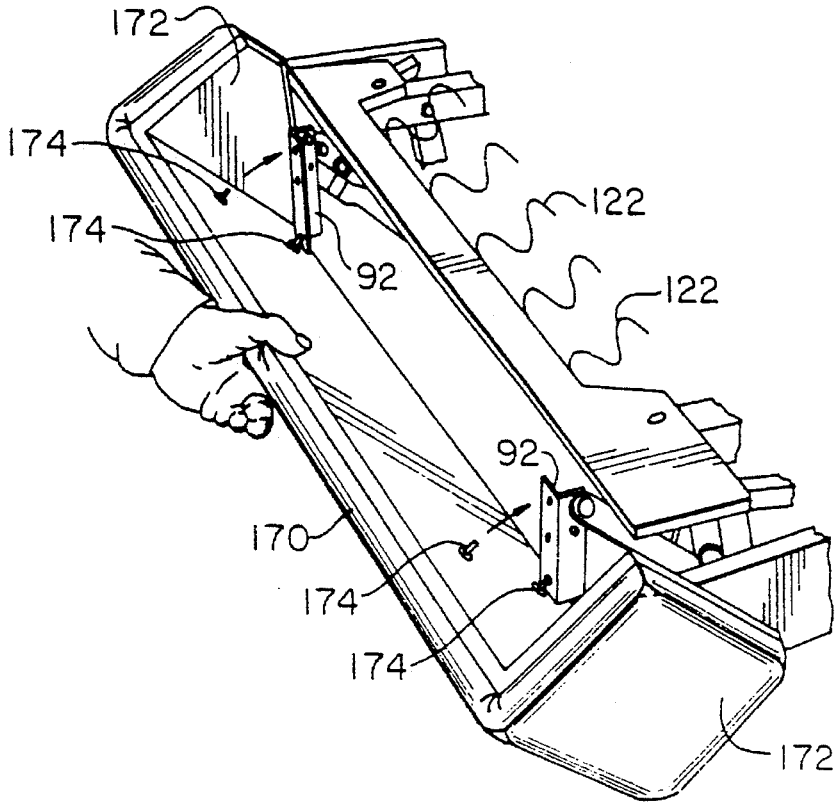
FIG. 9 is a perspective view of the ottoman of FIG. 8 showing the manner in which it is attached to the mechanism of FIG. 5.

The ottoman 26, as shown in FIGS. 3, 8 and 9, is generally U-shaped, having a main support panel 170 and a pair of returns 172 at each end thereof. When the ottoman is in the retracted position as shown in FIG. 1, the main panel 170 of the ottoman 26 lies in a vertical plane spaced slightly inward with respect to the front edge of the seat 20 and the returns 172 which also lie in vertical planes extend rearwardly from the main panel of the ottoman to the front of the arms 24. The returns 172 of the ottoman serve to enclose and cover a portion of the chair mechanism 28 and particularly the lazy tong linkage 90.

The ottoman 26 is fully upholstered on the outer surfaces of the main panel and the returns, so as to provide a fully finished appearance. The ottoman main panel carries screws 174 that are positioned to register with holes 176 in the ottoman mounting brackets 92 of the lazy tong linkages 90 to secure the ottoman to the mechanism.

Figure 12:
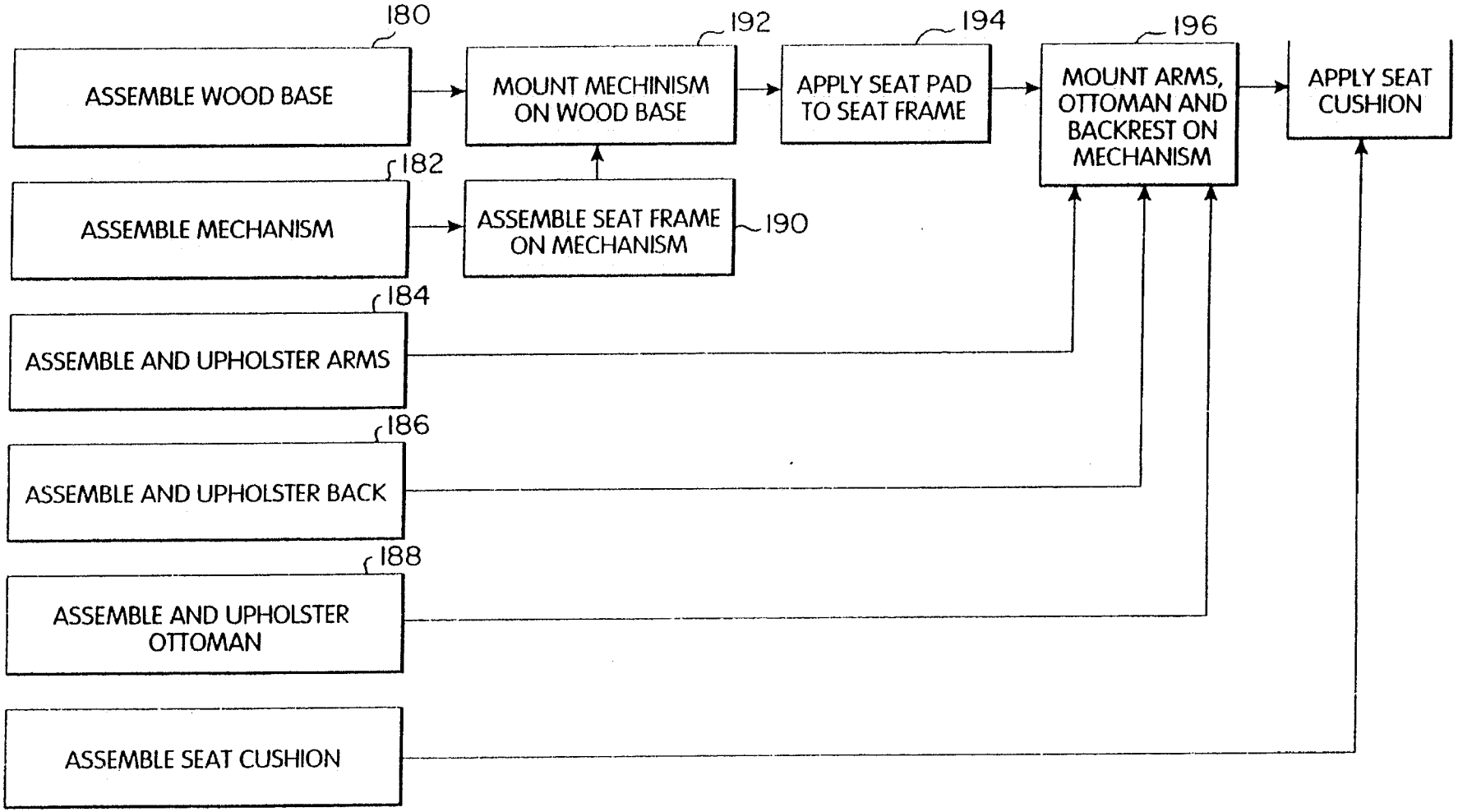
FIG. 12 is a block diagram showing the various steps in the manufacture of the different parts of the chair and the steps in which they are assembled.

It should be appreciated that the positions of the ottoman 26 in the extended and retracted positions is a function of the styling of the chair and the reclining mechanism utilized, and the present invention is not limited in any way to a specific style or mechanism. The ottoman, for example could be disposed beneath the seat in the retracted position and a mid-ottoman could also be mounted on the lazy tong linkages 90. In accordance with the present invention, the several components of the chair, including the base 40, reclining mechanisms 28, arms 24, seat frame 110 and backrest 22, are separately manufactured and are thereafter assembled together after the upholstered pieces are fully upholstered. The assembling of the components can be carried out by the-manufacturer, dealer, or consumer. This manufacturing process is suggested in the block diagram of FIG. 12. As is suggested in that figure, the wood base 40, reclining mechanism 28, arms 24, backrest 22 and ottoman 26 are all separately preassembled at separate work stations suggested by boxes 180, 182, 184, 186 and 188. Only the stations where the arms 24 and backrest 22 are assembled require the presence of skilled upholsterers. Normally, the reclining mechanisms and metal seat frame are not manufactured by the furniture manufacturer but rather are supplied by outside hardware vendors. The furniture manufacturer, however, mounts the mechanisms on the base as suggested by box 192 and will assemble the seat frame on the mechanism as suggested by box 190. Those steps are carried out at one station. It should be appreciated that the metal seat frame 110 may be made by securing the front and rear cross tubes 114 and 116 to the seat mounting links 80 of the mechanisms. In this fashion, the side rails 112 of the seat frame 110 are formed by the seat mounting links 80, and therefore the angle stock that forms the links 80 and side rails 112 need not be duplicated. At the same station, a seat pad may be placed over the springs 122 as indicated by box 194 particularly if a loose seat cushion is to be used as in the embodiment shown. Therefore, the arms, backrest, and ottoman may be attached to the mechanism-seat frame combination as suggested by the box 196.

The motion furniture described above has many important advantages. For example, a preassembled portion of the furniture comprising the base 20, mechanisms 28, seat frame 110 and ottoman 26 may be shipped to the dealer with the arms 24 and backrest 22 detached, to provide a smaller package to reduce stacking volume, shipping costs and damage to the furniture, and to promote ease of handling. Furthermore, the dealer can return a defective part for repair or replacement rather than the whole piece of furniture. As yet another advantage the dealer is able to make certain mechanism repairs faster and easier by removing the arms 24 and/or back 22.

Furniture manufactured in accordance with this invention significantly automates the furniture manufacturing operation by using fewer people, less space and less time with better quality control. In a conventional manufacturing line, there are ten to fourteen people requiring a space of 15'×60'. Fewer highly skilled upholsterers are used, and the separate work stations for (1) the installation of the hardware (mechanism) to the base and attachment of the metal seat frame, (2) the arm assembly, (3) back assembly and (4) ottoman assembly can be located anywhere in the plant and require minimum floor space. Better quality control can be achieved at each station, workers can build more pieces and mixed styles. The final assembly can be carried out at the factory or by the dealer or even the consumer.

While in the foregoing description the invention is described as it applies to a chair, the invention is not limited to that type of motion furniture alone. Rather, it has application to the manufacture of love seats and sofas as well.

Because numerous modifications may be made of this invention without departing from the spirit thereof, the scope of the invention is not to be limited to the single embodiment illustrated and described. Rather, the scope of the invention is to be determined by appended claims and their equivalents.

What is claimed is:

1. Ready to assemble upholstered motion furniture comprising:

a base and a reclining chair mechanism mounted on each side of the base, a metal seat frame mounted on the mechanisms on each side of the base, a preupholstered arm subassembly mounted on the metal seat frame and movable as a unit with the seat frame, a seat and preupholstered backrest mounted on the mechanisms, wherein the motion furniture is a chair and wherein two preupholstered arm subassemblies are mounted on the metal seat frame, one on each side thereof; and, wherein the metal seat frame has side rails and front and rear cross tubes, said cross tubes having ends extending outwardly beyond one of the side rails and said ends being connected to the arm subassembly.

2. An upholstered motion furniture construction comprising:

a base and a reclining chair mechanism mounted on each side of the base, a seat frame mounted on the mechanisms on each side of the base, an upholstered arm subassembly mounted on the seat frame and movable as a unit with the seat frame, a seat and upholstered backrest mounted on the mechanisms, wherein the motion furniture is a chair and wherein two upholstered arm subassemblies are mounted on the seat frame, one on each side thereof, and, the seat frame having side rails and front and rear cross tubes, said cross tubes having ends extending outwardly beyond one of the side rails and said ends being connected to the arm subassembly.

3. An upholstered motion furniture construction as recited in claim 2, wherein the connection between said ends and said arm subassembly is configured such that the arm subassembly can be removed without marring the upholstery.

4. An upholstered motion furniture construction as recited in claim 3, wherein the seat frame is constructed of metal.

5. An upholstered motion furniture construction as recited in claim 2, wherein the seat frame is constructed of metal.

6. An upholstered motion furniture construction comprising:

a base and a reclining chair mechanism secured to the base, a seat frame having front and rear cross members and side rails, said cross members having ends extending beyond at least one of the side rails, said seat frame attached to said reclining chair mechanism, an upholstered arm subassembly mounted on the seat frame and movable as a unit with the seat frame, said cross member ends being connected to the arm subassembly, and an upholstered backrest mounted on said reclining chair mechanism.

7. An upholstered motion furniture construction as defined in claim 6, further comprising:

two arm subassemblies mounted on the seat frame, wherein said cross member ends extend outwardly beyond both side rails and said cross member ends are connected to the arm subassemblies.

8. An upholstered motion furniture construction as recited in claim 6, wherein the connection between said ends and said arm subassembly is configured such that the arm subassembly can be removed without marring the upholstery.

9. An upholstered motion furniture construction as recited in claim 8, wherein the seat frame is constructed of metal.

10. An upholstered motion furniture construction as recited in claim 6, wherein the seat frame is constructed of metal.

11. An upholstered backrest as recited in claim 6, wherein the backrest is removably mounted on the reclining chair mechanism.

12. An upholstered motion furniture construction comprising:

a base and a reclining mechanism secured to the base, a seat frame including front and rear cross tubes, right and left side rails, said cross tubes having ends extending beyond the side rails; said seat frame attached to the reclining chair mechanism, upholstered arms separately Land detachably mounted on the ends of the cross tubes and movable as a unit with the seat frame, said arms including means for attaching and detaching the arms from the cross tubes without marring the upholstery of the arms, and an upholstered backrest separately and detachably mounted on the reclining mechanism, said backrest being movable with respect to the seat frame and the base, and means for attaching and detaching the backrest from the mechanism without marring the upholstery of the backrest.

* * * * *